US007296732B2

(12) United States Patent
Roddy

(10) Patent No.: US 7,296,732 B2
(45) Date of Patent: Nov. 20, 2007

(54) MAGNETICALLY SEALING MAIL SLOT FLAP

(76) Inventor: Steven T. Roddy, 20622 Wedgewood, Grosse Pointe Woods, MI (US) 48236

( * ) Notice: Subject to any disclaimer, the term of this patent is extended or adjusted under 35 U.S.C. 154(b) by 0 days.

(21) Appl. No.: 11/445,381

(22) Filed: Jun. 1, 2006

(65) Prior Publication Data

US 2006/0273146 A1 Dec. 7, 2006

Related U.S. Application Data

(60) Provisional application No. 60/686,121, filed on Jun. 1, 2005.

(51) Int. Cl.
*A47G 29/12* (2006.01)

(52) U.S. Cl. ..... 232/19; 232/45

(58) Field of Classification Search ..... 232/19, 232/45, 44, 1 E; 109/64, 66; 49/168, 478.1, 49/402

See application file for complete search history.

(56) References Cited

U.S. PATENT DOCUMENTS

| | | | | | |
|---|---|---|---|---|---|
| 746,906 | A * | 12/1903 | Wimer | 232/45 |
| 2,437,319 | A * | 3/1948 | Gable et al. | 232/45 |
| 2,595,535 | A * | 5/1952 | Nowakowski | 232/45 |
| 4,545,522 | A * | 10/1985 | Kerzner | 232/45 |
| 5,382,945 | A * | 1/1995 | Novak | 340/569 |
| 2006/0065705 | A1 * | 3/2006 | Plappert | 232/19 |

* cited by examiner

*Primary Examiner*—William L. Miller
(74) *Attorney, Agent, or Firm*—Fildes & Outland, P.C.

(57) ABSTRACT

An assembly for a door or wall having a mail slot therein includes a mounting portion and a flap portion. The flap portion is sized to cover the mail slot. A connector is mountable on the door or wall around the slot. A cooperable connector is integral with the flap portion for releasably connecting with the connector. The connector includes one of a ferrous material containing portion and a magnetic portion. The cooperable connector includes the other of the ferrous material containing portion and the magnetic portion. The flap portion is magnetically connectable to the door or wall around the mail slot opening.

16 Claims, 2 Drawing Sheets

MAGNETICALLY SEALING MAIL SLOT FLAP

CROSS REFERENCE TO RELATED APPLICATION

This application claims the priority of U.S. Provisional Application No. 60/686,121 filed Jun. 1, 2005.

TECHNICAL FIELD

This invention relates to mail slots in entry doors and in walls, and more particularly to sealing the opening forming the mail slot thereby to conserve energy.

BACKGROUND OF THE INVENTION

A mail slot is often provided or disposed in an entry door or an outer wall of a residence or business through which mail is delivered. For example, an entry door may include a rectangular aperture that defines the mail slot and also a flap disposed about the outward facing side of the door. Such flaps are usually hinged along a top edge and closed by gravitational force. Alternatively, the mail slot may be disposed in on an outer wall and may be located near to an entry door.

Often the flap used to close the opening is quite energy inefficient. It may be part of a trim pack designed for aesthetic purposes but not to prevent heat/cold transfer. Typically the flap is made of thin sheet material, often a metallic material that is highly conductive and aids in undesirable heat transfer. Further, the flap may not, and typically does not, seal around the opening to prevent air movement through the opening.

It is desirable to have provided a mail slot closing structure that aids in the conservation of energy.

SUMMARY OF THE INVENTION

The present invention provides a magnetic mail slot flap assembly for magnetically sealing around the opening on the interior side of a mail slot in an entry door or outside wall of a residence or commercial building. The magnetic sealing of the door flap inhibits heat transfer and prevents air movement, such as drafts, through the mail slot, resulting in energy savings when heating and cooling a building on which the entry door is disposed. The interior mail slot flap also provides a cover for the often unsightly interior opening of a mail slot.

More particularly, an assembly for a surface of a structural member such as a door or wall having a mail slot therein includes a mounting portion and a flap portion. The flap portion is sized to cover the mail slot. A connector is mountable on the surface around the slot. A cooperable connector is integral with the flap portion for releasably connecting with the connector. The connector includes one of a ferrous portion and a magnetic portion. The cooperable connector includes the other of the ferrous portion and the magnetic portion. The flap portion is magnetically connectable to the surface around the mail slot opening.

In a specific embodiment, the cooperable connector may comprise a flexible magnetically susceptible material. Alternatively, the cooperable connector may comprise a rigid material. The mounting portion may be mountable to the surface of the door or wall by one of an adhesive or one or more mechanical fasteners. The mounting portion may be integral with the flap portion. Alternatively, the mounting portion may be connected to the flap portion by a hinge.

In another embodiment of the present invention, a mail slot assembly is provided for a structural member such as a door or wall having an interior side, an exterior side, a slot extending from the exterior side to the interior side, and a connector portion surrounding the slot on the interior side of the door or wall. The assembly includes a cover sheet. The cover sheet is sized to cover the slot and includes a magnetically susceptible face. The cover sheet is mountable to the interior side of the door or wall such that the magnetically susceptible face is juxtaposed the interior side of the door or wall. The magnetically susceptible face is cooperable with the connector portion of the door or wall for releasable connection to the connector portion. Connecting the magnetically susceptible face to the connector portion of the door or wall seals the slot.

In this embodiment, the cover sheet may comprise a flexible material or alternatively may comprise a rigid material. The connector portion of the door or wall may be a thin ferrous material containing sheet mounted to the interior side of the door or wall and having an opening corresponding in size to the slot. The door or wall may be made of a non-ferrous material such as wood, a composite material, or another similar non-ferrous building material. The connector portion may then be mountable to the door or wall by an adhesive. Alternatively, the door or wall may be made of a ferrous material wherein the connector portion is integral with the door or wall. It should be understood, however, that the door or wall may be made of any material known in the art as a material for making doors or walls. The cover sheet may be mountable to the door or wall along an upper edge. The cover sheet may also be mountable to the door or wall by an adhesive, one or more mechanical fasteners, or other similar mounting means.

These and other features and advantages of the invention will be more fully understood from the following detailed description of the invention taken together with the accompanying drawings.

DETAILED DESCRIPTION OF THE INVENTION

Figure 1:
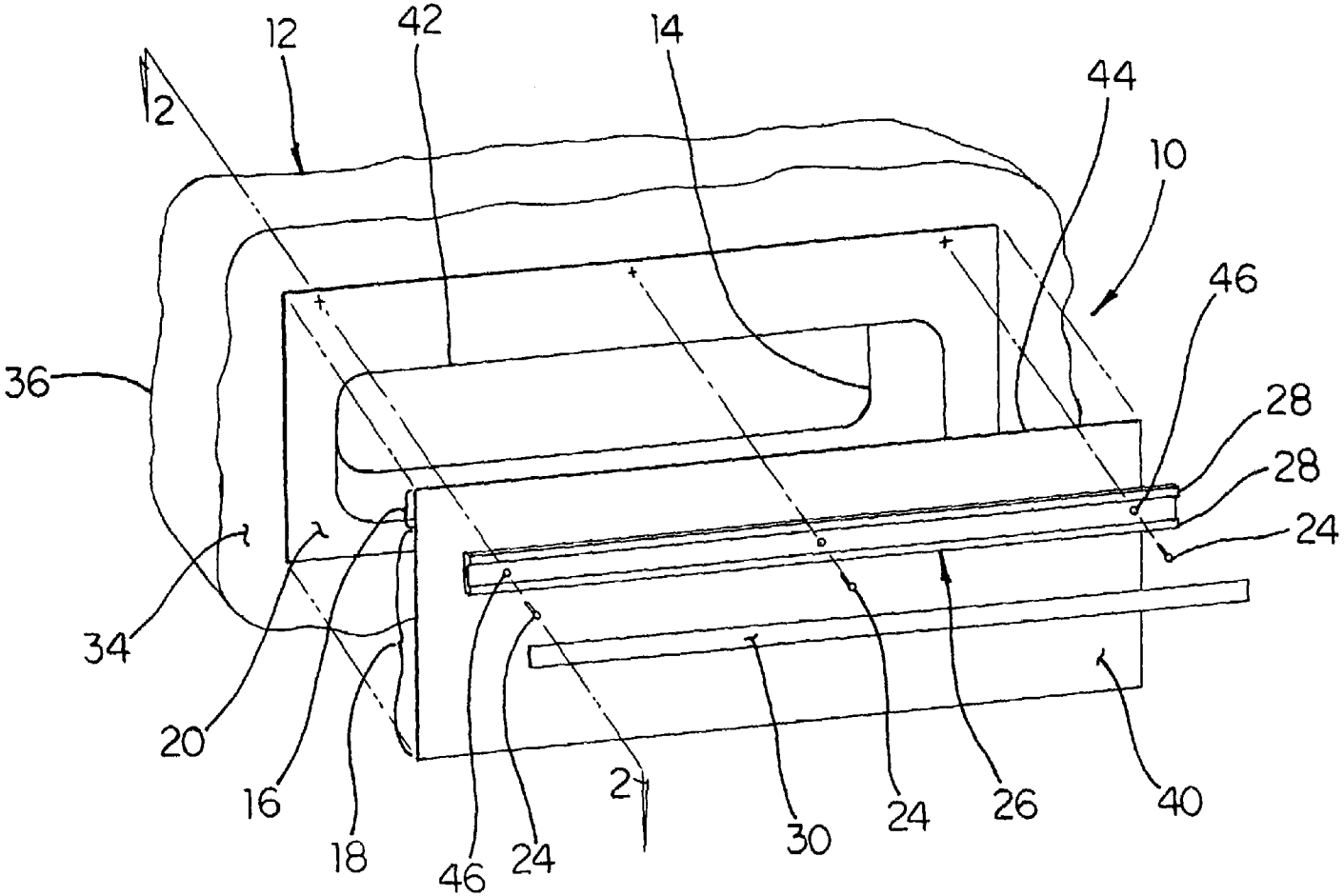
FIG. 1 is an exploded perspective view of a magnetic mail slot flap assembly in accordance with the invention.
Figure 2:
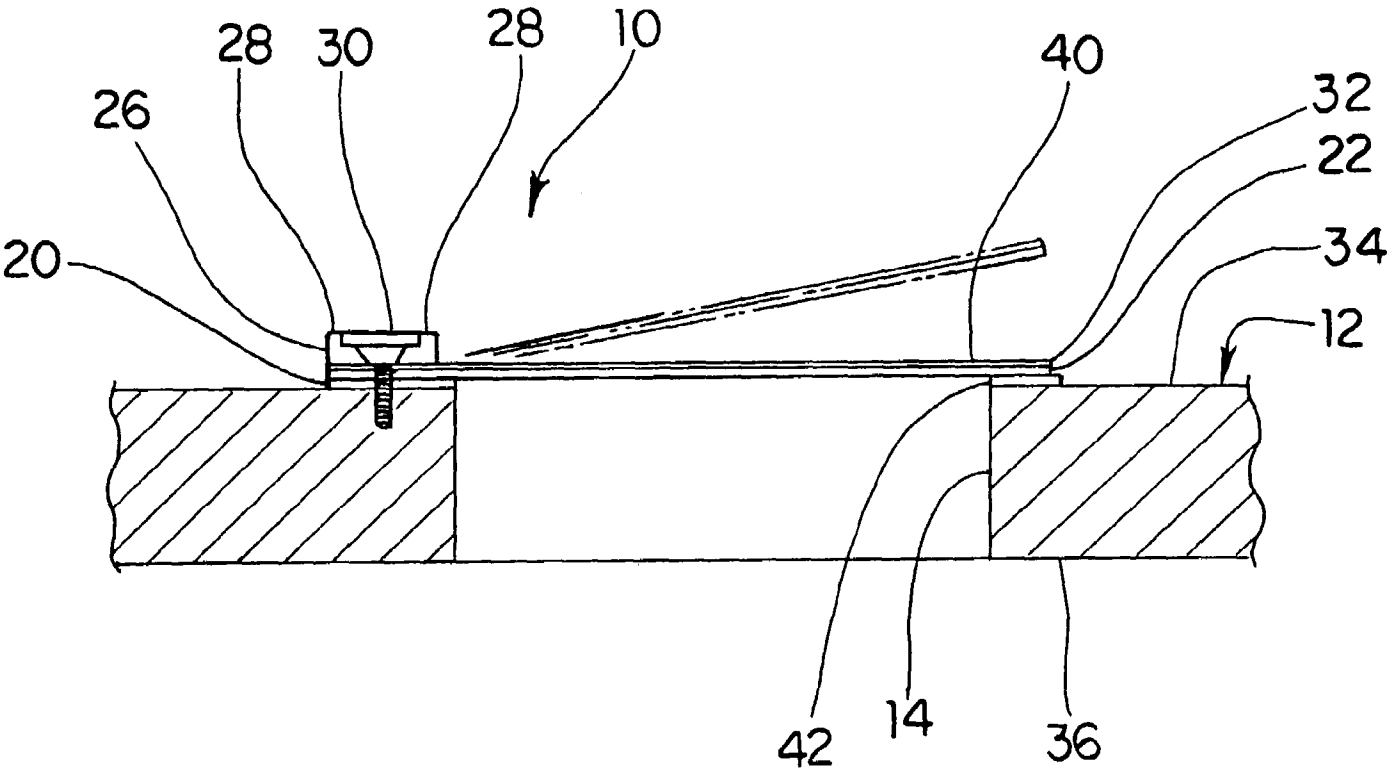
FIG. 2 is a cross-sectional view of the mail slot assembly taken along the line 2-2 in FIG. 1.

Referring now to the drawings in detail, numeral 10 generally indicates a magnetically sealing mail slot flap assembly in accordance with the present invention. The magnetically sealing mail slot assembly 10 provides a tight seal between the flap and the opening on the interior side of a mail slot in a door or outside wall of a residence or commercial building. The magnetically sealing mail slot assembly 10 thereby reduces heat transfer through the mail slot and in turn improves the efficiency of energy use for heating/cooling the area inside of the door or wall, which may be used as a living space or business. The magnetically sealing mail slot assembly 10 is also universally mountable on any entranceway door or outside wall having a mail slot, or even an angled surface having a mail slot. It should be understood that the present invention may be used to seal any mail slot disposed in a door, a wall, or other similar structural member. For simplicity, the following description will relate to mail slots in doors, although the invention is not limited solely to this example.

More particularly, an assembly 10 for a door 12 having a mail slot 14 therein includes a mounting portion 16 and a flap portion 18. The flap portion 18 is sized to cover the mail slot 14. A connector 20 is mountable on the door 12 around the slot 14. A cooperable connector 22 is integral with the flap portion 18 for releasably connecting with the connector 20. The connector 20 comprises one of a ferrous portion and a magnetic portion. The cooperable connector 22 comprises the other of the ferrous portion and the magnetic portion. If the connector 20 is the ferrous portion, then the cooperable connector 22 is the magnetic portion, or if the connector 20 is the magnetic portion, then the cooperable connector 22 is the ferrous portion. The ferrous portion and magnetic portion cooperate to form a magnetic connection between the connector 20 and the cooperable connector 22 in order to magnetically connect the flap portion 18 to the door 12 around the mail slot opening 14.

The mounting portion 16 may be mountable to the door 12 by an adhesive, one or more mechanical fasteners 24 such as screws or nails, or any other suitable, known mounting means. The assembly 10 may further include a mounting bar 26 that is placed on top of the mounting portion 16 prior to fastening the mounting portion to the door 12. The mounting bar 26 may include receiver(s) 28 for receiving and retaining a decorative strip 30. After mounting the mounting portion 16 to the door 12, the decorative strip 30 may be either slid or pressed into the receivers 28. The decorative strip 30 covers and hides the fasteners 24 to improve the appearance of an installed mail slot assembly 10.

The connector 20 may be integral with the door 12. For example, if the door is made of a ferrous metal material, the connector 20 may simply be the portion of the door 12 that surrounds the mail slot 14 on the interior surface of the door. Alternatively, if the door is made of wood or any other non-ferrous material, the connector 20 may be a thin sheet of a ferrous or magnetic material that is mountable around the mail slot opening 14 by an adhesive or other mounting means.

The cooperable connector 22 may comprise a flexible magnetically susceptible material and may be generally lightweight. The mounting portion 16 may then be integral with the flap portion 18. For example, the mounting portion 16 and flap portion 18 may be formed from a sheet of flexible magnetic material that may be laminated with a colored decorative layer 32. The decorative layer 32 is preferably the same color as the decorative strip 30. Further, the color of the decorative strip 30 and decorative layer 32 preferably are chosen to match the color of the door 12. The decorative layer 32 may also include decorative art. Alternatively, the cooperable connector 22 may comprise a rigid material. The mounting portion 16 may then be connected to the flap portion 18 by a hinge so that the flap portion 18 may open and close. The cooperable connector 22 may be contiguous with the entire flap portion 18 or may only be disposed along a peripheral edge of the flap portion.

In a specific embodiment of the present invention, the mail slot assembly 10 is provided for a door 12 having an interior side 34, an exterior side 36, a slot 14 extending from the exterior side 36 to the interior side 34, and a connector portion 20 surrounding the slot 14 on the interior side 34 of the door 12. The assembly 10 includes a flexible cover sheet 40 integrally comprising the mounting portion 16 and flap portion 18. The cover sheet 40 is sized to cover the slot 14 in the door 12 and includes a magnetically susceptible face that forms the cooperable connector 22. The cover sheet 40 is mountable to the interior side 34 of the door 12 such that the magnetically susceptible face is juxtaposed, i.e. face to face with, the interior side 34 of the door 12. The magnetically susceptible face 22 is cooperable with the connector portion 20 of the door 12 for releasable connection to the connector portion 20. Connecting the magnetically susceptible face 22 to the connector portion 20 of the door 12 seals the slot 14.

In this embodiment, the connector portion 20 of the door 12 may be a thin ferrous material containing sheet mounted to the interior side 34 of the door 12 and having an opening 42 corresponding in size to the slot 14 in the door 12. The door 12 may be made of a wood material, a composite material, or other non-metallic, non-ferrous material. The connector portion 20 may then be provided as part of the assembly 10 and may be mountable to the door 12 by an adhesive or other suitable, known mounting means. Prior to mounting the connector portion 20 to the door 12, a release liner or backing sheet may cover the adhesive side of the connector portion to protect the connector portion from premature sticking to other objects. It is necessary to mount the connector portion 20 to the door prior to mounting the cover sheet 40. Alternatively, if the door 12 is made of a ferrous material, the connector portion 20 is an integral portion of the door surrounding the mail slot 14. The cover sheet 40 may then be directly mounted to the door 12. It should be understood that the door may be made of any material known in the art as a material for making doors. The cover sheet 40 may be mountable to the door 12 along an upper edge 44 of the cover sheet 40. The cover sheet 40 may also be mountable to the door 12 by an adhesive, one or more mechanical fasteners 24, or other similar mounting means.

To mount the mail slot assembly 10 to a door 12, any existing mail slot assembly must be removed from the interior surface 34 of the door. The surface 34 should also be clean and dry. Next, if a separate connector portion 20 sheet must be used (i.e., for a door that is non-ferrous), the connector portion 20 sheet may be centered about the slot 14 and then mounted to the interior surface 34 of the door 12. If the connector portion 20 includes an adhesive surface, any backing sheet present on the adhesive side should be removed to mount the connector portion 20. The connector portion 20 may have a pre-sized opening 42 made to match the size of the slot 14. Alternatively, part of the connector portion 20 may need to be removed in order to match the size of the opening 42 with the slot 14.

Next, the mounting bar 26 is aligned with the mounting portion 16 of the cover sheet 40 and the cover sheet is aligned with the connector portion 20. The location of holes 46 in the mounting bar 26 are marked on the cover sheet 40. The mounting bar 26 is removed and, with the cover sheet 40 aligned with the connector portion 20, holes are driven through the cover sheet 40 and connector portion 20, and into the door 12. The holes 46 in the mounting bar are realigned with the holes in the cover sheet 40 and connector portion 20, and the cover sheet 40 is mounted to the door by driving fasteners 24 through the aligned holes. The decorative strip 30 may then be placed in the receiver(s) 28 in the mounting bar 26 to cover the fasteners 24.

In use, the magnetic mail slot door flap 10 is opened by applying force against the flap portion 18 from the exterior side 36 of the door such as by a mail carrier inserting mail through the mail slot 14. When the mail or other object passes all the way through the mail slot 14, gravity closes the flap portion 18 and a magnetic seal is effected between the connector portion 20 and the cooperable connector 22. The mail slot assembly 10 thereby creates an airtight seal between the flap portion 18 and the door 12. The mail slot assembly 10 also improves the appearance of the interior side 36 of the door 12 by covering over the open slot 14 in the door.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A mail slot assembly for a surface having a mail slot therein, the mail slot assembly comprising:

a cover sheet including a mounting portion mountable to said surface and a flap portion;

said flap portion being sized to cover said mail slot;

a connector mountable on said surface around said slot;

a cooperable connector integral with said flap portion for releasably connecting with said connector;

said connector including one of a ferrous portion and a magnetic portion;

said cooperable connector including the other of said ferrous portion and magnetic portion;

whereby said flap portion is magnetically connectable to said surface around said mail slot opening.

2. The mail slot assembly of claim 1, wherein said cooperable connector comprises a flexible material.

3. The mail slot assembly of claim 1, wherein said cooperable connector comprises a rigid material.

4. The mail slot assembly of claim 1, wherein said mounting portion is mountable to said surface by one of an adhesive and a mechanical fastener.

5. The mail slot assembly of claim 1, wherein said mounting portion is connected to said flap portion.

6. The mail slot assembly of claim 1, wherein said mounting portion is integral with said flap portion.

7. A mail slot assembly for a structural member having an interior side, an exterior side, a slot extending from the exterior side to the interior side, and a connector portion surrounding the slot on the interior side of the structural member, the mail slot assembly comprising:

a cover sheet sized to cover the slot and including a magnetically susceptible face;

said cover sheet being mountable to the interior side of said structural member;

said magnetically susceptible face being cooperable with said connector portion of said structural member for releasable connection to said connector portion;

wherein connecting said magnetically susceptible face to said connector portion of said structural member seals said slot.

8. The mail slot assembly of claim 7, wherein said cover sheet comprises a rigid material.

9. The mail slot assembly of claim 7, wherein said cover sheet comprises a flexible material.

10. The mail slot assembly of claim 7, wherein said connector portion of said structural member is a thin ferrous material containing sheet mounted to the interior side of said structural member and having an opening corresponding in size to the slot.

11. The mail slot assembly of claim 10, wherein said structural member comprises a non-ferrous material.

12. The mail slot assembly of claim 7, wherein said structural member comprises a ferrous material and said connector portion is integral with said structural member.

13. The mail slot assembly of claim 7, wherein said cover sheet is mountable to said structural member along an upper edge.

14. The mail slot assembly of claim 7, wherein said cover sheet is mountable to said structural member by an adhesive.

15. The mail slot assembly of claim 7, wherein said cover sheet is mountable to said structural member by one or more mechanical fasteners.

16. The mail slot assembly of claim 7, wherein said connector portion is mountable to said structural member by an adhesive.

* * * * *